United States Patent [19]

Meyer et al.

[11] Patent Number: 4,546,845

[45] Date of Patent: Oct. 15, 1985

[54] ELECTROPNEUMATIC DOOR CONTROL

[75] Inventors: Dietmar Meyer; Horst Scheibe, both of Barsinghausen, Fed. Rep. of Germany

[73] Assignee: WABCO Fahrzeugbremsen GmbH, Hanover, Fed. Rep. of Germany

[21] Appl. No.: 441,455

[22] Filed: Nov. 15, 1982

[30] Foreign Application Priority Data

Jun. 22, 1981 [DE] Fed. Rep. of Germany ..... 3124398

[51] Int. Cl.[4] ..... E05F 15/20; F15B 15/20

[52] U.S. Cl. ..... 180/286; 49/31; 303/6.1; 91/392

[58] Field of Search ..... 49/13, 14, 28, 29, 30, 49/31; 105/341, 343; 180/281, 286; 246/182 R, 182 B; 303/6.1; 340/53; 91/392

[56] References Cited

U.S. PATENT DOCUMENTS

| | | | |
|---|---|---|---|
| 272,099 | 2/1883 | Strack | 49/14 |
| 2,311,806 | 2/1943 | Almond | 303/6.1 |
| 3,575,604 | 4/1971 | Smith | 180/281 |
| 3,884,437 | 5/1975 | Linderman | 246/182 R |
| 3,916,567 | 11/1975 | Daugirdas | 49/28 |
| 3,958,783 | 5/1976 | Rhoton | 246/182 B |
| 4,339,843 | 7/1982 | Burnett, Jr. | 49/30 |
| 4,478,131 | 10/1984 | Liermann et al. | 91/392 |

FOREIGN PATENT DOCUMENTS

| | | | |
|---|---|---|---|
| 1708446 | 9/1973 | Fed. Rep. of Germany . | |
| 2924996 | 6/1979 | Fed. Rep. of Germany . | |
| 2928801 | 7/1979 | Fed. Rep. of Germany . | |
| 3032516 | 8/1980 | Fed. Rep. of Germany . | |
| 3020972 | 12/1981 | Fed. Rep. of Germany | 49/28 |

*Primary Examiner*—Robert E. Garrett
*Assistant Examiner*—H. Edward Li
*Attorney, Agent, or Firm*—A. G. Williamson, Jr.

[57] ABSTRACT

An electropneumatic door control for vehicles is disclosed which consists of a pneumatic portion and an electronic portion. The electronic portion processes successive commands actuated by the vehicle operator to channel the signals to the pneumatic portion of the apparatus to activate alternate door openings and closings. Any blockage of the door movement is detected and signals processed to reverse the door closing or to halt the opening until the fault is corrected. The electronic portion also assures that the vehicle doors can only be opened after the vehicle has come to a stop, that when the vehicle doors are open the station or parking brake is held engaged, and that an audible warning signal sounds for a predetermined interval before the closing of the door.

2 Claims, 3 Drawing Figures

ELECTROPNEUMATIC DOOR CONTROL

BACKGROUND OF THE INVENTION

Our invention pertains to an electropneumatic door control system. More particularly, the invention pertains to an improved door control arrangement in which the door opening is enabled only when the train has stopped at a station and an open door condition locks the station or parking brake of the train separately from the regular braking.

Electropneumatic door controls with reverser apparatus are used primarily in public transportation facilities, for example, such as passenger buses. The controls are generally activated either pneumatically or electropneumatically when the driver actuates a control device to open or close the door in accordance with his desires. This action, by means of a door control valve, sends compressed air to a door drive mechanism designed as a door cylinder in which the stroke movements of the cylinder piston actuate the opening and closing motions of the door, which is generally of a type which has two portions which fold or move in opposite directions to provide the passenger opening. Since such doors have to be operated under all sorts of operating conditions, including improper operation by passengers, the control has to fulfill a number of limiting conditions. For example, it is generally required that the closing motion of a pneumatically-operated vehicle door automatically reverse into an opening motion if persons or objects are caught in the closing door The door must also operate under severe operating conditions which occur, for example, in the colder part of the year when the kinematics of the door change due to low temperature and when movement of the door can be blocked by snow or ice. There is also a danger that persons or objects can be caught in the door during an opening motion. Since the reversal of the direction of an opening door would present additional danger for subsequent persons entering or leaving the vehicle, it is customary to provide an electropneumatic switching device which brings the opening door to a stop by exhausting the pneumatic equipment.

It has become apparent that the large number of specific limiting conditions for the door operation cannot be satisfied with the traditional electromagnetic equipment except at a relatively high cost. To create such a door control system which is capable of meeting all the required conditions simply and at a low cost, that is, specifically without the use of additional valves or pressure switches, it has been proposed that an electronic system be provided to monitor and control the door. This electronic arrangement includes a door position flip-flop as an electronic indication of the existing door position. A basic system of this type is disclosed in the copending U.S patent application, Ser. No. 295,393, filed Aug. 24, 1981, Pat. No. 4,478,131, for Peter Liermann et al, entitled Electropneumatic Door Control Apparatus, which has a common assignee with the present application. However, it has been found desirable to add to the basic system disclosed in that application so that the doors may be opened only when the vehicle is assuredly stopped, that with the doors open a station or parking brake is separately applied, and that an audible warning is provided before the vehicle doors begin to close.

Accordingly, an object of our invention is an improved vehicle door control system employing electronic circuitry to control the electropneumatic elements and providing assurance that the vehicle has stopped prior to opening the doors and that it remains stopped while the doors are in the open condition.

Another object of the invention is a door control system for transit vehicles including electronic control arrangements, for the electropneumatic door controllers, which further enables the opening of the vehicle doors only when the vehicle is fully stopped, holds engaged or active the station or parking brake while the doors are open, and provides an audible warning signal for a timed period prior to the reclosing of the doors Other objects, features, and advantages of this invention will become apparent from the following specification and appended claims when taken in connection with the accompanying drawings.

SUMMARY OF THE INVENTION

The door control system of the invention consists of an electronic portion and a pneumatic portion which interact to effect the opening and closing of the doors of the vehicle. Door commands requesting the opening or closing of the door are processed by the electronic portion and applied to position the door control valve to supply air to the operating cylinders to move the door in the desired direction. A registry of the existing door position is maintained within the electronic apparatus so that each successive command is so processed as to move the door into the opposite position. A pneumatic reverser switch is coupled to the door operating cylinders to detect any blockage of the door movement to reverse and/or complete the electric connections to and from the electronic arrangement. This switch is normally operated to the opposite position at the end of the door movement but any new electric connections completed at that time are interrupted by limit switches, one of which opens with the door in each maximum position. When this reverser switch operates due to a blockage while the door is closing, the electric signals are immediately applied and processed by the electronic system to command the door to reopen. However, if an opening door is blocked, for example, something is caught in its trailing end, the reverser switch operation actuates another valve which exhausts the air pressure from the door cylinders to halt movement. The vehicle operator must then manually reverse or override the fault condition when the blockage or other condition is cleared. The electronic system also includes a logic network which processes a car speed signal together with a door opening signal to permit the door open signal to become effective only when the vehicle is assuredly stopped. The speed signal is provided by some form of speed measuring apparatus on the vehicle itself. This logic output is also coordinated with the usual door position registry and monitoring elements to actuate the proper door command as successive commands are issued by the operator. Additional logic separately applies a parking or station brake control to hold the train halted while the door is open if the regular braking is released or for some reason is removed. In addition, the electronic apparatus provides an audible warning which is controlled through the electronics for a predetermined time interval prior to the instant that the closing of the doors begins. This delays the effect of the door-closing command for the associated time interval.

BRIEF DESCRIPTION OF THE DRAWINGS

Before defining the invention in the appended claims, we shall describe in more detail a specific door opening control system embodying the inventive features, as shown in the accompanying drawings, in which:

In each of the drawing figures, similar reference characters designate the same or similar parts of the apparatus.

DESCRIPTION OF THE ILLUSTRATED EMBODIMENT

Figure 1:
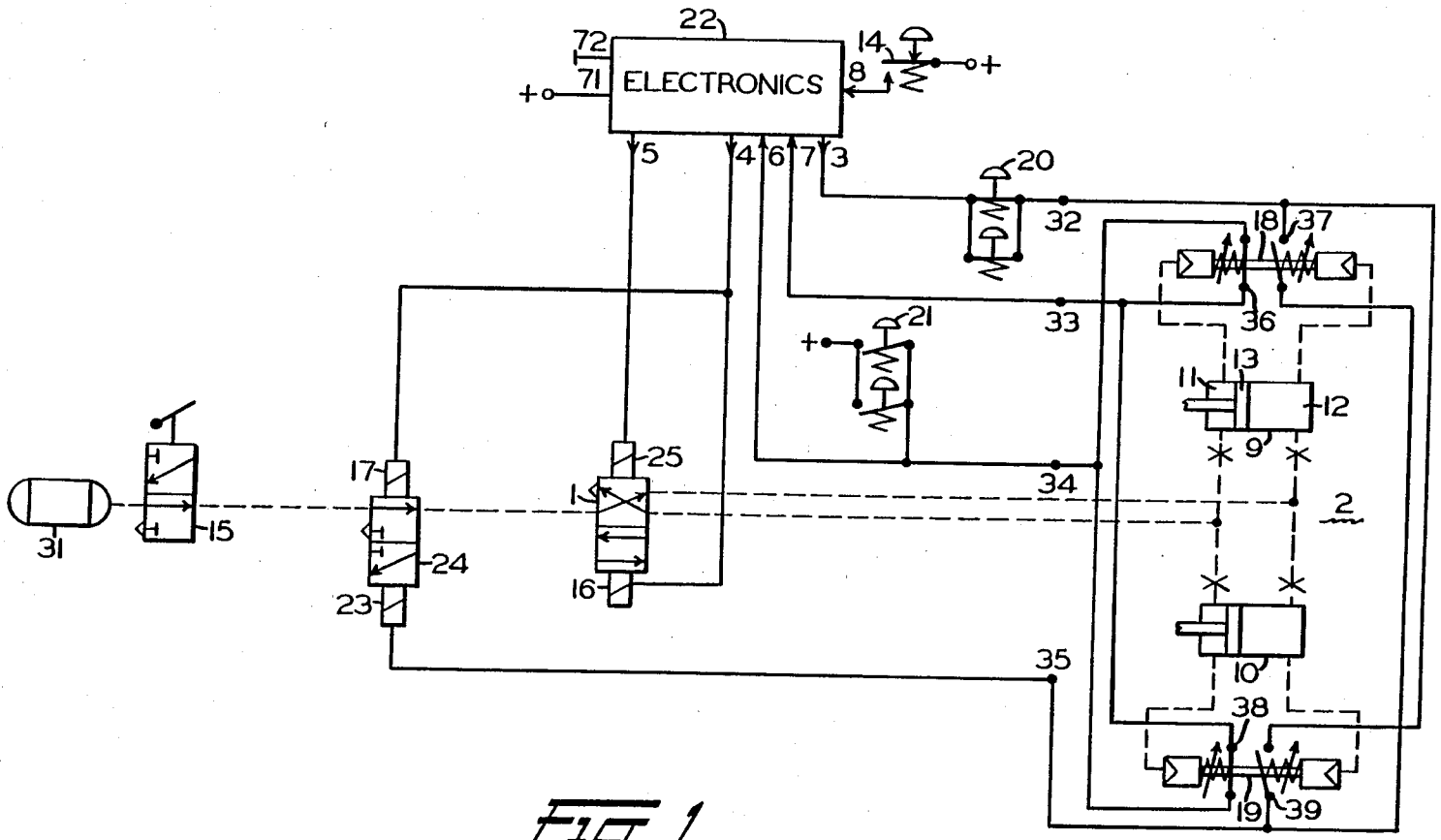
FIG. 1 is a schematic circuit diagram of the basic electronic-electropneumatic door control system to which the novel features of the invention may be added.

Referring now to FIG. 1, there is illustrated a schematic diagram of the combined electrical, electronic, and pneumatic connections for a basic door control system. The electrical signal flow lines are shown by solid lines with conventional symbols for the switches, contacts, and valve solenoids. The pneumatic, that is, compressed air connections, are illustrated by dashed lines with the valves and controllers designated by conventional symbols. The compressed air reservoir or source 31 is connected with a pneumatic door drive 2 by means of an emergency cock 15, a valve 24, and a door valve 1. The door drive element 2 consists of a pair of working cylinders 9 and 10, each of which drives one of the two wings or portions of the vehicle door. Working cylinder 9 contains two chambers 11 and 12 and a piston 13 while working cylinder 10 is correspondingly constructed. The working cylinders 9 and 10 are shown with their pistons in the position which they occupy with the vehicle door fully closed. The chambers 11 and 12 of cylinder 9 are each pneumatically connected with the two inputs of a reverser switch 18 while the chambers of cylinder 10 are correspondingly connected with inputs of a pneumatic reverser switch 19. The reverser switches include electrical switching contacts 36, 37, and 38, 39, respectively. Each reverser switch changes position when the piston of the associated working cylinder reaches the end of its stroke so that there is a pressure buildup in the pressurized chamber. For example, when piston 13 reaches its left position to completely close the door, the pressure buildup in chamber 12 moves the switch 18 to its left position, in which it is shown, closing contact 36 and opening contact 37. When the door is opened, the pressure buildup in chamber 11 operates reverser switch 18 to the right-hand position, reversing the positions of contacts 36 and 37. Similar operation of switch 19, to shift positions of contacts 38 and 39, is actuated by the pressures in the chambers of working cylinder 10. If the door portion becomes blocked in either direction of operation, a corresponding or equivalent pressure buildup in the active chamber actuates a similar operation by the associated reverser switch at that time.

The switch contacts 37 and 39 are connected in parallel between terminals 32 and 35. Contacts 36 and 38 are also connected in parallel but between the terminals 33 and 34. Terminal 32 is connected by means of a limit switch 20, whose contacts open when the doors are in their fully open position, to an output terminal 3 of electronic apparatus designated by the block 22 having power terminals 71 and 72. Terminal 33 is connected to an input 7 of the electronic apparatus block 22. Terminal 34 and the input 6 of block 22 are connected by means of another limit switch 21, whose contacts open when the doors are in their fully closed position, to an operating voltage source. The two limit switches 20 and 21 each includes a pair of contacts connected in parallel, one contact being associated with each of the two portions of the controlled door. In keeping with the condition shown in the FIG. 1, it is to be noted that the contacts of switch 20 are closed while the contacts of switch 21 are open since the full door is assumed to be in its fully closed position.

Electronic apparatus 22 also has an input 8 which is connected to the operating voltage source by means of a normally open push button 14, which is accessible to and actuated by the vehicle operator each time he wishes to move the door to a new position. Another output 4 of the electronics 22 is connected to the magnet or solenoid 16 for activating door valve 1 to its opposite position to open the doors. Terminal 4 is also connected to the magnet or solenoid 17 of valve 24 to hold this valve element in its illustrated position. A final output 5 of the electronic apparatus 22 is connected to the solenoid 25 for activating door valve 1 to its shown position to close the vehicle doors. In other words, door open commands appear at output 4 of the electronics 22 while the door closing commands appear at output 5. Finally, terminal 35 is connected to the solenoid or magnet 23 of valve 24. When this solenoid is energized, it operates valve 24 to its opposite position to blank the connection to the reservoir 31 and connect the pneumatic line from valve 1 to atmosphere to exhaust the door operating cylinders.

The operation of the door control apparatus will now be explained with initial reference to FIG. 1. A reversal of the door position takes place in the usual manner following each activation of push button 14 by the operator. Door valve 1 is reversed from its existing position and the previously exhausted chambers of the door working cylinders 9 and 10 are pressurized. For example, under the illustrated condition, the operation of button 14 actuates an open door command on output 4 of electronic apparatus 22. This energizes solenoid 16 to move valve 1 to its opposite position and energizes solenoid 17 to hold valve 24 in its existing condition. Chamber 11 of cylinder 9 is thus supplied from reservoir 31 over the pneumatic channels through emergency cock 15 and valve 24 in the illustrated positions and door valve 1 in its opposite position. Chamber 12 of cylinder 9 is exhausted at this time through the other passage in the lower portion of repositioned valve 1. The left chamber of cylinder 10 is likewise pressurized and the opposing chamber exhausted. The doors move then to the open position at which time switches 18 and 19 reverse, limit switch 20 opens its contacts, and switch 21 meanwhile has closed its contacts. The next operation of push button 14 actuates apparatus 22 to output a close command signal on terminal 5, which initiates the door closing operation with an obvious reversal of valve 1 and resulting change in the pressurized condition in cylinders 9 and 10. Once again limit switches 20 and 21 change position, at the completion of the door operation, to that shown in the drawing.

If, during the closing action of the door, something or someone gets caught, for example, in the portion associated with cylinder 9, the doors must reverse, that is, must open again. The obstacle or blockage is detected in a known manner by the pressure difference in the cylinder chambers 11 and 12 with particular buildup in chamber 12. The door blockage is reported to the electronic apparatus 22 by means of the reverser switch 18 which immediately changes position to close its contact 36 and open 37. Since limit switch 21 is closed at this instant, that is, the door not fully closed, energy, i.e., a signal, is applied over terminal 34 and contact 36 from the source to input 7 of apparatus 22. This is processed and apparatus 22 sends a pulse over output 4 to solenoid 16 of door valve 1 which shifts position to actuate an opening of the door, that is, a reversal action.

If an obstacle is caught in the rear edge of the door while it is opening, switch 18 or 19 detects the pressure difference in the operating cylinder chambers and immediately reverses its position, closing contact 37 or 39. Valve 24 is then activated to shift its position by a signal appearing at output 3 of electronic apparatus 22 which flows over the still closed contacts of limit switch 20, terminal 32, switch contact 37 or 39, and terminal 35 to solenoid magnet 23. When valve 24 shifts position, the air in the left chambers of the door cylinders 9 and 10 is exhausted to atmosphere and the doors stop in place. Since the doors are not to reverse when they have reached their limit position, that is, fully open or fully closed, in spite of the reversing of the switches 18 and 19, the limit switches 20 and 21 have been provided in order to interrupt the flow of these various signals to reverse or halt door operation.

Figure 2:
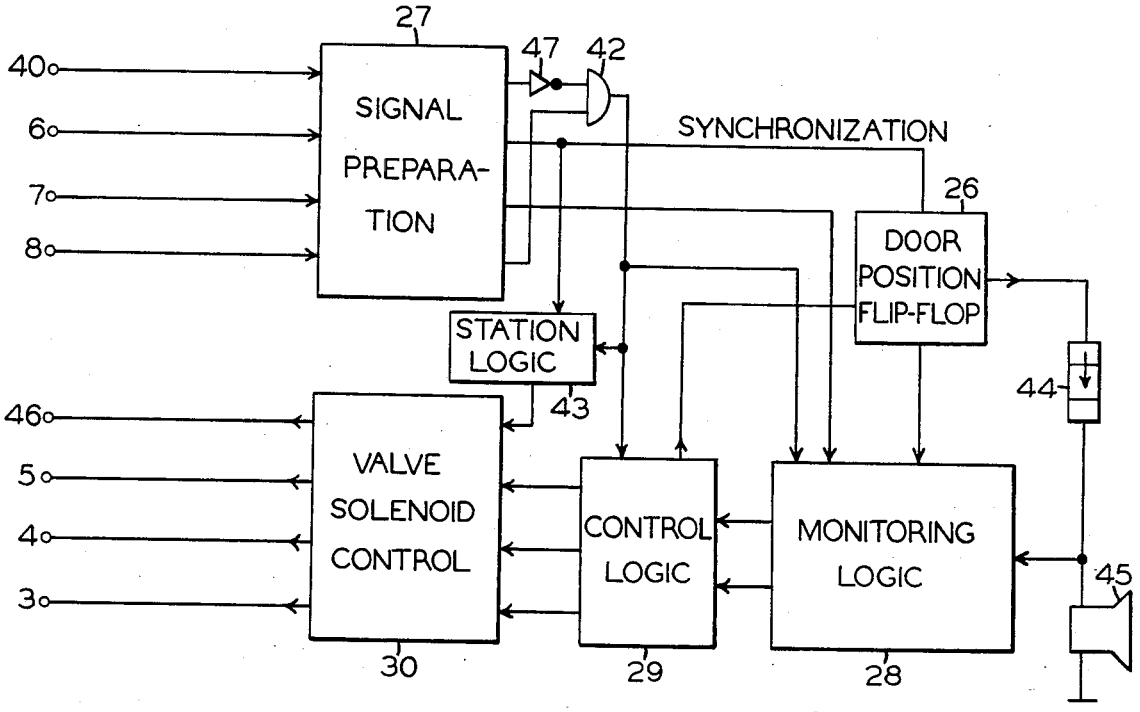
FIG. 2 is a block diagram of an expanded electronic arrangement for the system of FIG. 1 which provides the additional features of the invention.

FIG. 2 shows an expanded block diagram of the electronic apparatus 22 of FIG. 1. Various functions are designated by conventional blocks only, since different electronic circuitry or circuit elements can be used in accordance with the desired design, as will be understood from the description, and the circuit specifics are not critical to the understanding. The signal preparation unit 27 is connected by input 6 with the limit switch 21, by input 7 to the reverser switch terminal 33, and by input 8 to the pushbutton 14. Signal preparation element 27 processes the signals from these connected switches and push buttons and adapts them by means of a well known damping network, e.g., an RC combination, and with Schmitt triggers to the voltage conditions in the subsequent electronic apparatus. The door position flip-flop unit 26 responds to the existing door position. When the electronic system 22 is turned on, the flip-flop 26 is preset according to the position of the limit switches and then always shifts with each operation of door valve 1. In this manner, the existing door status is always stored in flip-flop 26.

The monitoring logic of block 28 detects from the condition of the door position flip-flop 26 and from the door command given with push button 14 which monitoring function is desired, i.e., which possible door blockage is to be monitored. The control logic in block 29 takes the door command and the signals from the monitoring logic, links them, and forwards them to the valve solenoid control element 30. The valve solenoid control 30 contains power limit stages to control door valve 1 through the outputs 4 and 5. In addition, valve 24 may be reversed by a signal from output 3 through the reverser switch contacts 37 or 39 and terminal 35 to solenoid 23, as shown in FIG. 1. One feature of the door control system is that the monitoring functions can be overridden by a command issued from the push button 14. The door can thus be opened and closed even if it is blocked or slowed down by snow and ice in cold weather operation. If, due to inattention by the vehicle operator, a passenger is caught in the door with a permanent door command, the corresponding monitoring function, that is, reversal, is automatically reactivated after the triggering of the door command ceases, that is, push button 14 is released.

The electronic apparatus 22 as illustrated in FIG. 2 operates as follows during a blockage condition. Assume that the door is to be closed by a door command applied to input 8 of the electronic system from push button 14. As a result of an obstruction, a reversal command, as previously described, appears, at input 7. This is detected by the monitoring logic 28, then applied through control logic 29 to the valve solenoid control 30. This results in an open command on output 4 to solenoid 16 of valve 1 which reverses the door operation and drives the door in the opening direction. But, if a door override command is present at input 8, that is, the operator continues to activate push button 14, then the reverse command in the monitoring logic block 28 is overridden. If, before the limit switch 21 is activated, the door command on button 14 is released, the control signal to door valve 1 at output 5 disappears, and the monitoring logic block releases the reverse signal Thus, by means of control logic 29, valve solenoid control 30, and output 4, the door is opened.

If a blockage occurs or something is caught in the trailing edge while the door is being opened with an input signal on terminal 8, the resulting signal on terminal 35 (FIG. 1) shifts valve 24 to exhaust the active chambers of the operating cylinders. This exhaust is overridden, even if there is an obstacle in the opening direction, as long as the door command is present on input 8. In other words, if the doors are being opened by a signal at input 8, the release of the monitoring signal for the rear edge of the door, to output 3, is overridden by the monitoring logic block 28. The door, thus, can be completely open, even if blocked by ice or snow, by a long push on button 14 by the vehicle operator without the door operating chambers being exhausted by the monitoring system. If the door command from button 14 is terminated, the monitoring logic block again releases the monitoring signal for the rear edge and, by means of control logic 29 and valve solenoid control 30, controls output 3. If the limit position of the door has not then been reached, that is, limit switch 20 is still closed, and an obstacle is in the path of the door, the operating chambers are immediately depressurized.

This basic arrangement is expanded by adding an inverter 47, AND gate 42, station logic unit 43, and audio signal unit 45 with its delay element 44. An additional input 40 is provided for the signal preparation element 27 which supplies a 3 km/h recognition signal to the electronic system of the door apparatus. For example, this can be generated by a tachometer located on each vehicle so that the input 40 is positive when the vehicle speed exceeds the value of 3 km/h. After processing through signal preparation unit 27, there is a logic linkage between inputs 40 and 8 through the inverter 47 and AND gate 42 elements, in effect, a NAND gate logic network. This means that a door command on input 8 can only be supplied to the monitoring logic 28 and control logic 29, if the speed of the vehicle is less than the selected 3 km/h. Thus, without any additional cost, the doors of the vehicle such as a standard bus can be made to open only after the vehicle has come to a stop. It is impossible with this apparatus to open the vehicle doors during travel and before the vehicle has stopped at a station or wayside stop.

Figure 3:
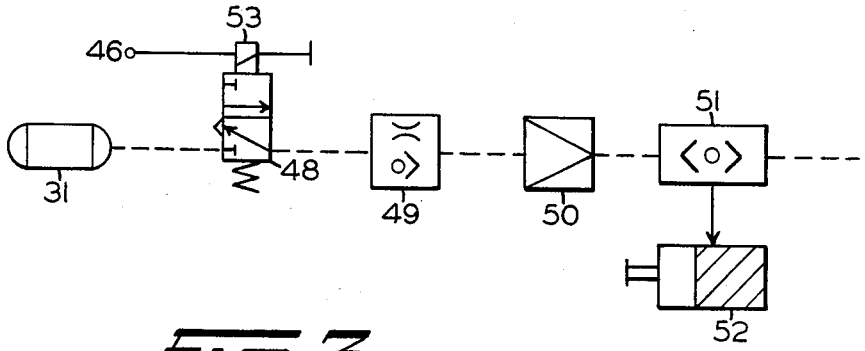
FIG. 3 shows a schematic electropneumatic diagram for a station or parking brake arrangement to be used with the door control apparatus of FIGS. 1 and 2.

Also provided is a station brake or parking brake arrangement, as shown schematically in FIG. 3, which supplements the regular vehicle brake apparatus to retain such a vehicle halted at a station while the doors remain open. By means of a 3/2-way valve 48, when in its opposite position to that illustrated in FIG. 3, pressurized air travels from the source or reservoir 31 through a check valve 49 to a pressure reducing or regulator valve 50. This latter reduces the operating pressure to, for example, 3 bars. If there is now, at a subsequent 2-way valve 51 which is coupled to the operating vehicle brake equipment, a regular brake pressure lower than the pressure set in the reducer 50, then the vehicle is braked by means of a brake cylinder 52 with the reduced pressure of 3 bars supplied through this arrangement of FIG. 3.

To offer an optimum of safety and ease for the vehicle operator, the invention provides an additional output 46 from the valve solenoid control 30 of the electronic apparatus 22 (FIG. 2), which directly controls solenoid 53 of the valve 48 of the station braking arrangement. This additional output 46 is generated by a station logic system 43 which links the input 6 for the door position flip-flop with the combined logic signal from input 8 for the door command and input 40 for the 3 km/h signal. This processing is accomplished so that output 46 from valve solenoid control 30 occurs when the speed of the vehicle is dropped below 3 km/h and a command signal has been given to open the doors. Output 46 is then deenergized only if a door command was given before the closing of the door. As a result of this logic linkage, operation of the station brakes is independent of fluctuating pressure values in the door equipment and thus also independent of improper operation if the pressure in the equipment fails. The logic linkage is not simply dependent on the position of the door since, in addition, a door command must be initiated previously by the vehicle operator.

If emergency cock or valve 15 of the door apparatus is activated and the door panels are closed by hand, the station brake remains engaged. This takes responsibility from the driver since the station brake is activated when the vehicle brake itself is activated and also when the door is opened. To open the door, not only must the station brake be engaged but, as a result of the linkage with the 3 km/h recognition signal, the vehicle must come to a stop before the door is opened.

In accordance with the third element added by the invention, a door closing warning signal is provided to alert the passengers, before the closing of the vehicle doors, by means of an audible warning signal of the impending action. Before the closing of the doors, the door position flip-flop 26 is in its open registry condition and will be shifted into its closed condition by the next door command. When flip-flop 26 is registering this open position, the next door command over input 8 travels into the electronic system and adjustable timing or delay element 44 is activated. For the time period of this timing element, the monitoring logic system 28 is locked out and an audible transmitter 45 is actuated. This means that the execution of the door command and thus the reversal of the door into the closing direction takes place only after the expiration of the length of time delay set by timing element 44.

Although we have herein shown and described but one arrangement for adding the three features of our invention to the basic door control apparatus, it is to be understood that various changes and modifications within the scope of the appended claims may be made without departing from the spirit and scope of our invention.

Having now described the invention, what we claim as new and desire to secure by Letters Patent, is:

1. Electropneumatic door control apparatus for controlling opening and closing movements of a vehicle door which provides entry and exit for passengers, comprising, (a) fluid pressure operable controller means connected to said vehicle door and responsive to selectively supplied fluid pressure for alternately opening and closing said door, (b) a source of pressurized fluid, (c) valve means coupled to said source and said controller means and responsive to selective signals for supplying pressurized fluid to actuate said controller means to open and close said door, (d) an electronic circuit means coupled to receive door movement request signals and door response signals and responsive for processing the received signals and supplying selective signals to said valve means to actuate the requested door movements, (e) a logic network coupled to receive a current vehicle speed signal generatd by a sensor located on said vehicle and a door command signal and operable for enabling said electronic means to supply an open door command signal to said valve means only when said vehicle speed is less than a predetermined safe level, (f) said logic network having a NAND gate means coupled to receive door movement request signals and said vehicle speed signal for supplying a request signal to said electronic circuit means only when vehicle speed is less htan said predetermined safe level, (g) a parking brake control means coupled to respond to said open door command signal from said logic network and to a door not closed signal from said electronic circuit means for assuring vehicle brake action to hold said vehicle halted while said door is open, (h) said praking brake control means having station logic means coupled to said electronic circuit means and responsive to sequential open door request signal and a door open indication signal for supplying a brake signal, and (i) brake control means coupled to said station logic means and responsive to a brake signal for assuring the continued application of vehicle brakes while the vehicle remains halted and said door open.

2. Door control apparatus as defined in claim 1, which further includes, (a) first and second limit switches connected for detecting full open and full closed positions of said door, respectively, and in which said fluid pressure operable controller means comprises, (b) door cylinder means coupled to said valve means and connected for alternately opening and closing said door as pressurized fluid is selectively supplied by said valve means, (c) reverser switch means operable to a first and a second position and controlled by said door cylinder means for operating to first and second positions when door opening and closing movement is completed, respectively, or when a blockage condition impedes a door opening or closing movement, respectively, and (d) said limit switches and said reverser switches jointly controlling said electronic circuit means for actuating a halt of a door opening movement or a rereversal of a door closing movement if a blockage condition is registered prior to completion of the door movement.

* * * * *

UNITED STATES PATENT AND TRADEMARK OFFICE

CERTIFICATE OF CORRECTION

PATENT NO. : 4,546,845

DATED : October 15, 1985

INVENTOR(S) : Dietmar Meyer & Horst Scheibe

It is certified that error appears in the above-identified patent and that said Letters Patent are hereby corrected as shown below:

Column 8, line 37, change "htan" to --than--

Column 10, line 1, change "rereversal" to --reversal--

Signed and Sealed this

*Twentieth* Day of *May 1986*

[SEAL]

*Attest:*

DONALD J. QUIGG

*Attesting Officer*

*Commissioner of Patents and Trademarks*